US009809426B2

(12) United States Patent
Lee

(10) Patent No.: US 9,809,426 B2
(45) Date of Patent: Nov. 7, 2017

(54) LOW-SPEED BRAKE APPARATUS FOR ESCALATOR

(71) Applicant: MIJUHITEC CO., LTD., Seoul (KR)

(72) Inventor: Ho Yeon Lee, Seoul (KR)

(73) Assignee: Mijuhitec Co., LTD., Seoul (KR)

( * ) Notice: Subject to any disclaimer, the term of this patent is extended or adjusted under 35 U.S.C. 154(b) by 0 days.

(21) Appl. No.: 15/317,062

(22) PCT Filed: Jun. 5, 2015

(86) PCT No.: PCT/KR2015/005687
§ 371 (c)(1),
(2) Date: Dec. 7, 2016

(87) PCT Pub. No.: WO2015/190763
PCT Pub. Date: Dec. 17, 2015

(65) Prior Publication Data

US 2017/0113903 A1 Apr. 27, 2017

(30) Foreign Application Priority Data

Jun. 9, 2014 (KR) ..... 10-2014-0069556

(51) Int. Cl.
*B66B 25/00* (2006.01)
*B66B 29/00* (2006.01)

(52) U.S. Cl.
CPC ..... *B66B 25/00* (2013.01); *B66B 29/00* (2013.01)

(58) Field of Classification Search
CPC ..... B65B 29/00
USPC ..... 198/322, 323, 330
See application file for complete search history.

(56) References Cited

U.S. PATENT DOCUMENTS 3,580,376 A * 5/1971 Loshbough ..... B66B 29/005 198/323
4,600,865 A * 7/1986 Caputo ..... B66B 25/00 198/321
4,863,006 A * 9/1989 Kotkata ..... B66B 29/005 198/323

(Continued)

FOREIGN PATENT DOCUMENTS

JP 2006-036397 2/2006
JP 2008-037602 2/2008

(Continued)

*Primary Examiner* — Douglas Hess
(74) *Attorney, Agent, or Firm* — Kramer & Amado, P.C.

(57) ABSTRACT

The present invention relates to a low-speed brake apparatus for an escalator, comprising: a brake sprocket mounted on a drive shaft for a step; a driven sprocket connected to the brake sprocket through a brake chain to operate in conjunction with the brake sprocket; an electronic clutch that controls a connection between the driven sprocket and a transmission gear; a brake motor of which the central shaft is rotated by the transmission gear; a plurality of switching means connected to a plurality of winding wires that are stators of the brake motor; and a controller for supplying an operating pulse to a selected switching means. Therefore, when there is an abnormality in an escalator, it is possible to stop a step at a low speed according to an operating pulse supplied by the controller, thereby stably stopping riders standing on the step and thus protecting the riders.

4 Claims, 8 Drawing Sheets

(56) References Cited

U.S. PATENT DOCUMENTS

| | | | | |
|---|---|---|---|---|
| 5,125,481 | A * | 6/1992 | Shibata | B66B 9/00 187/245 |
| 6,155,401 | A * | 12/2000 | Lunardi | B66B 23/026 198/322 |
| 6,267,219 | B1 * | 7/2001 | Spannhake | B66B 29/005 198/322 |
| 6,666,319 | B2 * | 12/2003 | Balzer-Apke | B66B 29/005 198/322 |
| 7,931,136 | B2 * | 4/2011 | Webster | B65G 19/02 198/322 |
| 8,396,588 | B2 * | 3/2013 | Senger | B66B 29/005 700/230 |
| 8,607,958 | B2 * | 12/2013 | Makovec | B66B 29/00 198/322 |
| 8,800,743 | B2 * | 8/2014 | Berger | B66B 29/00 198/322 |
| 2013/0228417 | A1 | 9/2013 | Tautz et al. | |

FOREIGN PATENT DOCUMENTS

| | | |
|---|---|---|
| JP | 2010-006486 | 1/2010 |
| JP | 2011-148633 | 8/2011 |
| JP | 2013-049539 | 3/2013 |
| KR | 100995059 B1 | 11/2010 |
| KR | 1020117030796 | 10/2013 |

* cited by examiner

LOW-SPEED BRAKE APPARATUS FOR ESCALATOR

BACKGROUND OF THE INVENTION

Field of the Invention

The present invention relates to a linear brake apparatus for an escalator and, more particularly, to a low-speed brake apparatus for an escalator in which the step and hand rail of the escalator are linearly braked optimally.

Discussion of the Related Art

As noted, an escalator is installed in buildings having a variety of types of structures. The escalator in which steps are installed on an endless track can move much many people than an elevator to an upper floor or a lower floor. The escalator has an open type structure to enable people thereon to see a view around. The escalator is widely installed on department stores, hotels, large shopping centers, and subway stations.

The structure of such an escalator is described below. A driving motor for generating a motive power for up and down driving steps connected to the endless track onto which a passenger steps and driving sprockets connected to the driving shaft of the driving motor are connected by a driving chain. Step sprockets rotated when the driving shaft is rotated by the motive power of the driving motor moves step chains, so the escalator operates to go up and down.

Such an escalator has a main brake included in the driving motor and is driven by a controller, if necessary. The escalator is suddenly braked when a safety accident, such as a get-between accident, occurs by stopping the rotational movement of the driving motor.

The driving sprockets on both sides of the steps for the step driving of the escalator are connected by the driving shaft. The driving chain inserted into a driving motor rotation shaft rotates the driving sprockets, thereby driving the steps.

Accordingly, when the driving chain connecting the driving motor and the sprockets of the driving shaft and transferring a motive power is broken, although the braking power of the main brake operates, the braking power cannot be transferred to the steps of the escalator. Accordingly, the steps of the escalator are suddenly accelerated while going down due to weight itself and weight of a passenger. The steps of the escalator are stopped while going up, instantly reversed, and accelerated to go down. Accordingly, there is a problem in that a serious injury accident is frequently generated because a passenger loses his or her balance due to inertia upon going up or down and falls down forward.

A representative example of such an escalator includes Korean Patent Application Publication No. 20-0466157 entitled "Disk hydraulic caliper type safety brake control apparatus for emergency stop of escalator for heavy load" (hereinafter referred to as a "cited invention").

The cited invention relates to the disk hydraulic caliper type safety brake control apparatus for an emergency stop of escalator for a heavy load, as shown in FIG. 1, including step chains on which the steps of the escalator are installed, an escalator rotation shaft 30 equipped with driving sprockets 36 engaged with the respective step chains and adapted to move the step chains up or down while rotating forward or backward by a driving motor 21, a counter rotation detection sensor which senses the rotation direction of the escalator rotation shaft 30, an overspeed detection sensor which senses the rotation speed of the escalator rotation shaft 30, an emergency stop safety brake 40 configured to block the rotation of the escalator rotation shaft 30 by a mechanical force, and a control unit configured to determine whether abnormality occurs in response to signals from the counter rotation detection sensor and the overspeed detection sensor and to control the emergency stop safety brake 40.

The emergency stop safety brake 40 includes a disk brake 41 additionally installed on the escalator rotation shaft 30 and hydraulic calipers 42 configured to limit the rotation of the disk brake 41 by simultaneously applying pressure on both sides of the disk brake 41 and to operate in response to a signal from the control unit.

The emergency stop safety brake 40 is installed in accordance with the central portion of the escalator rotation shaft 30 so that the central portion of the escalator rotation shaft 30 can be braked.

The cited invention has a problem in that a serious safety accident may occur because passengers stepping onto the steps of the escalator fall down due to inertia if the escalator going down at a high speed is rapidly braked by a hydraulic caliper type emergency stop safety brake although the driving chain is broken.

SUMMARY OF THE INVENTION

In order to solve such problems, an object of the present invention is to propose a low-speed brake apparatus for an escalator, which can prevent an injury of a passenger attributable to sudden braking through smooth deceleration to the extent that the passenger stepping onto a step does not fall down if it is necessary to stop a movement of the step while the escalator operates.

In order to achieve the object, a low-speed brake apparatus for an escalator includes a brake sprocket installed on a driving shaft, wherein step sprockets engaged with step chains and a driving sprocket are respectively installed on both sides of the driving shaft and a driving chain inserted into the rotation shaft of a driving motor rotates the driving sprocket so that a step is driven, a follower sprocket connected to the brake sprocket by a brake chain in such a way as to operate in conjunction with the brake sprocket, an electronic clutch regulating connection between the follower sprocket and a transmission gear, a brake motor having a center shaft rotated by the transmission gear, a plurality of switching means connected to a plurality of windings, that is, the stator of the brake motor, and a controller for supplying an operation pulse to selected switching means.

DETAILED DESCRIPTION OF THE EMBODIMENTS

A low-speed brake apparatus for an escalator includes a brake sprocket installed on a driving shaft, wherein step sprockets engaged with step chains and a driving sprocket are respectively installed on both sides of the driving shaft and a driving chain inserted into the rotation shaft of a driving motor rotates the driving sprocket so that a step is driven, a follower sprocket connected to the brake sprocket by a brake chain in such a way as to operate in conjunction with the brake sprocket, an electronic clutch regulating connection between the follower sprocket and a transmission gear, a brake motor having a center shaft rotated by the transmission gear, a plurality of switching means connected to a plurality of windings, that is, the stator of the brake motor, and a controller for supplying an operation pulse to selected switching means.

Embodiments of the present invention are described in detail below with reference to the accompanying drawings so that those skilled in the art to which the present invention pertains readily implement the present invention.

Figure 1:
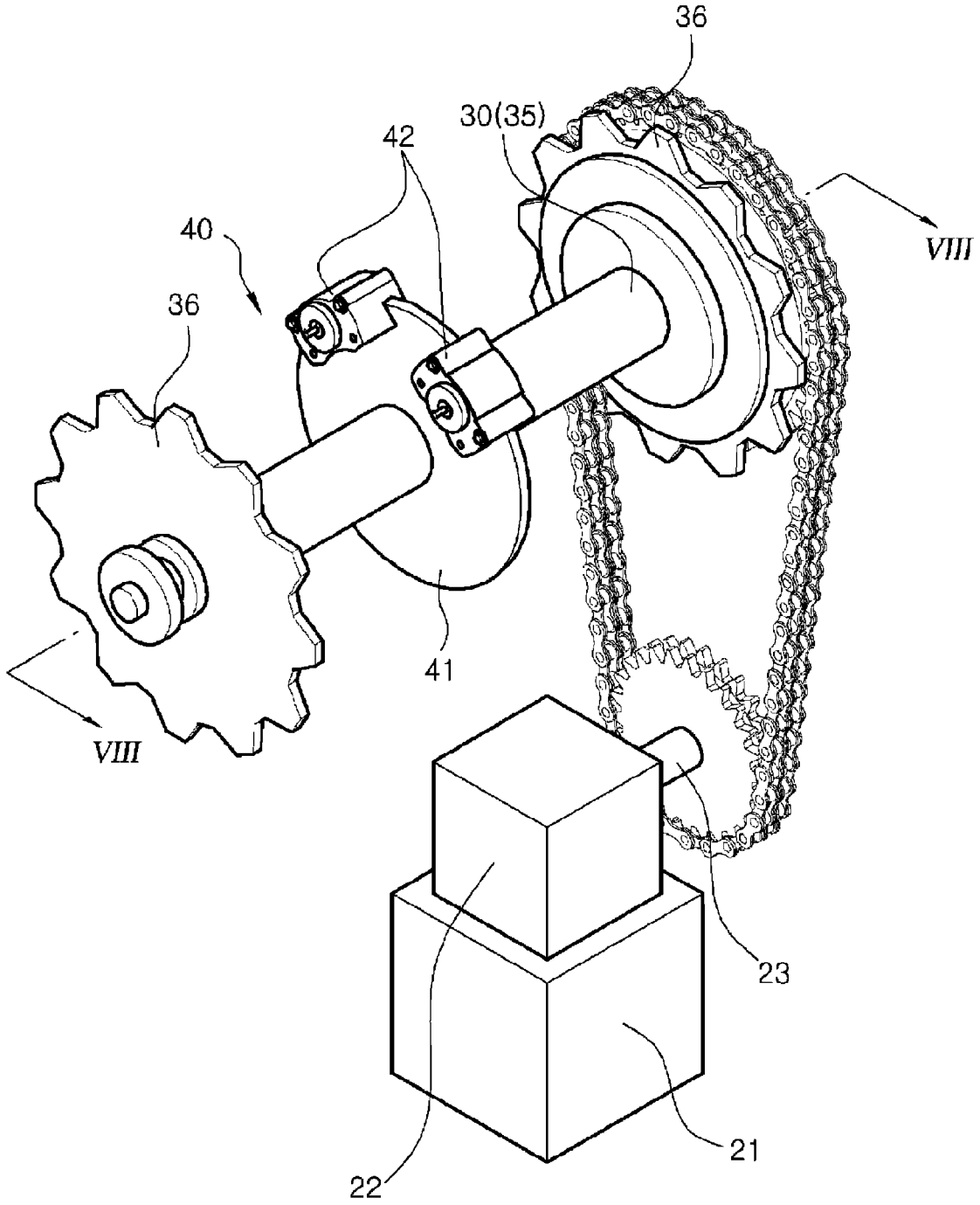
FIG. 1 is a perspective view showing a conventional disk hydraulic caliper type emergency stop safety brake control apparatus of an escalator for a heavy load.
Figure 2:
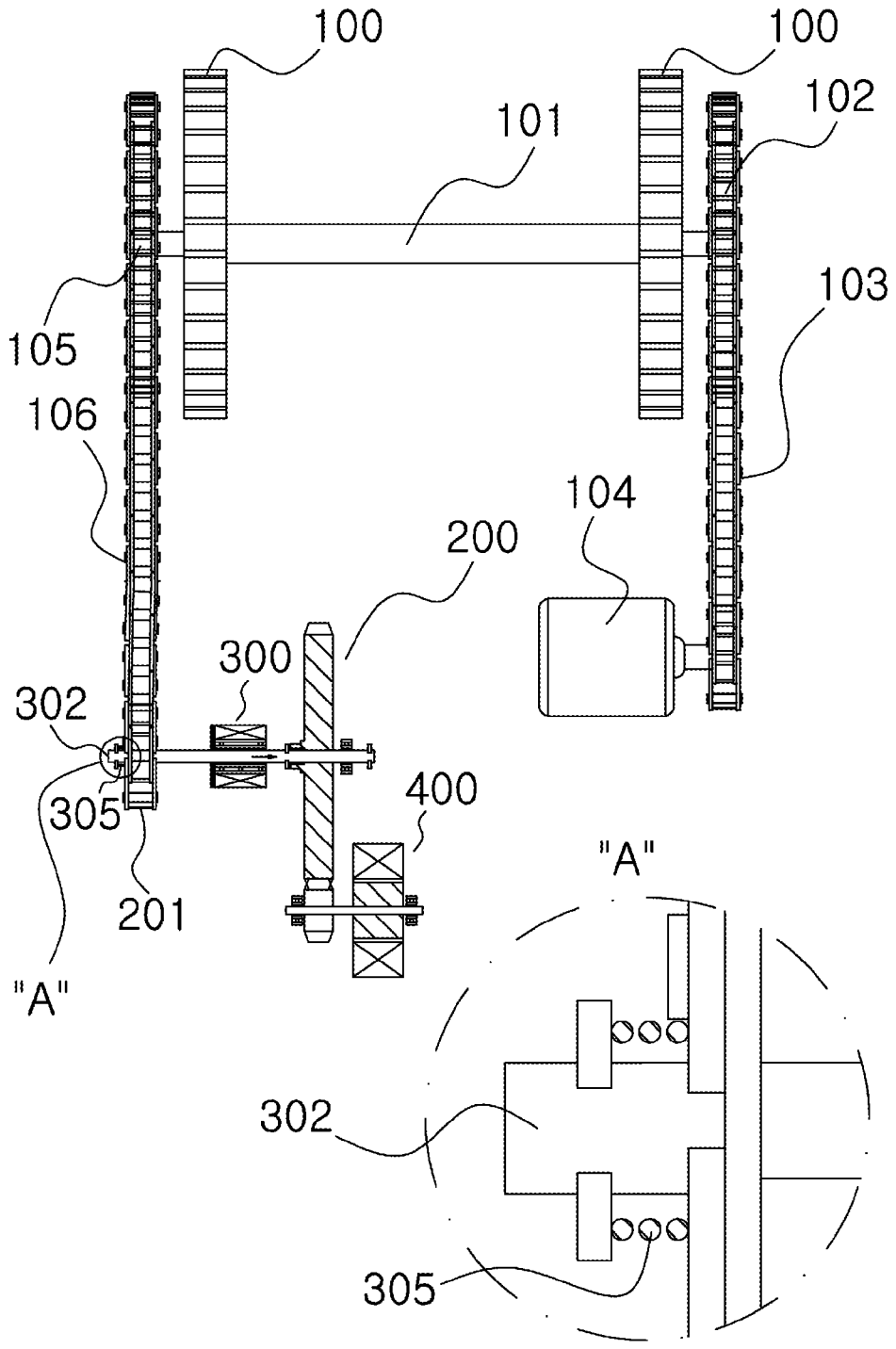
FIG. 2 is an explanatory diagram showing main elements of an escalator to which the present invention has been applied.
Figure 3:
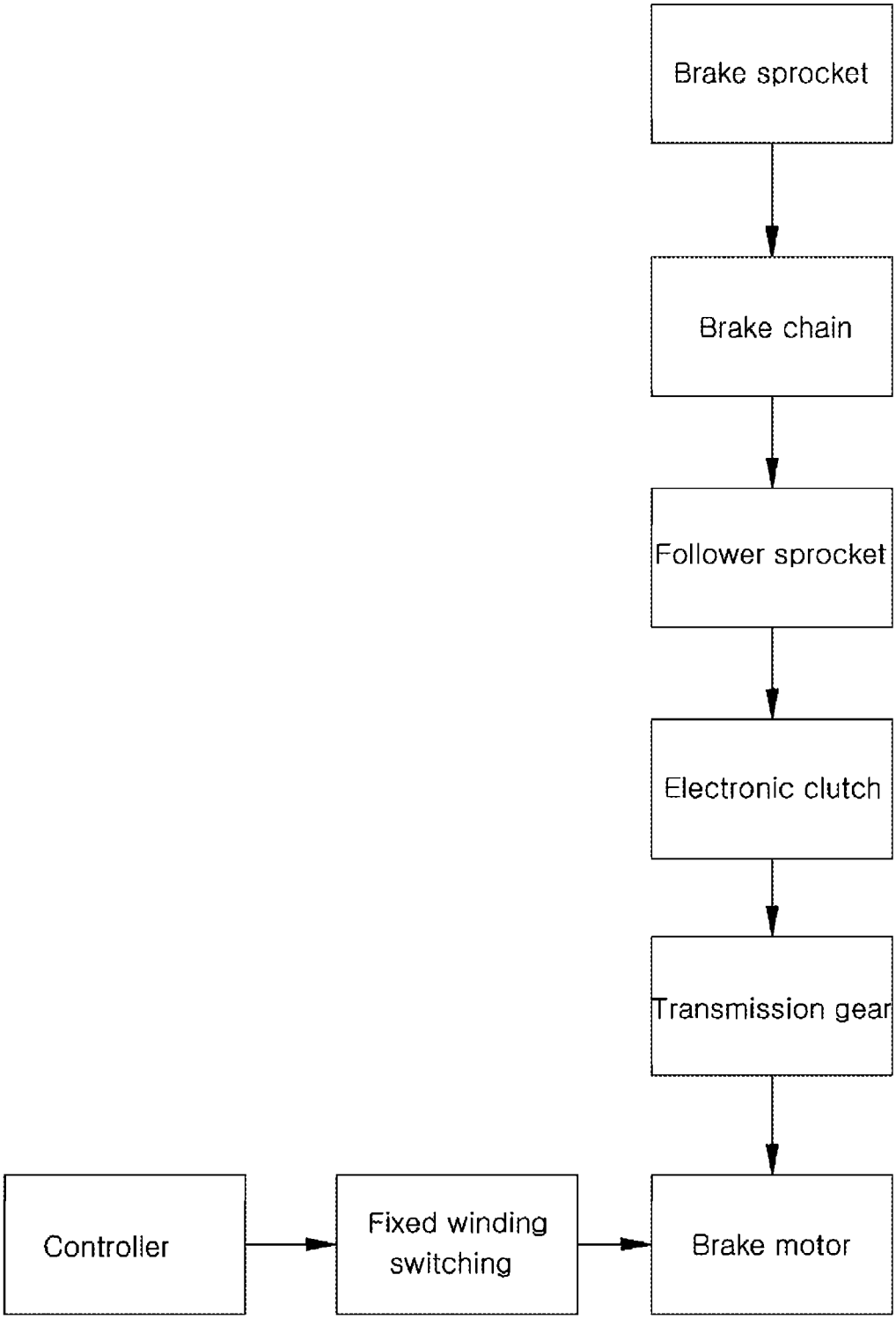
FIG. 3 is a schematic view of a low-speed brake apparatus for an escalator according to the present invention.

An overall configuration of an escalator to which a low-speed brake apparatus for an escalator according to the present invention has been applied is shown in FIG. 2. The elements of the escalator are schematically shown in FIG. 3 in order that a motive power is transferred upon braking.

As may be seen from the following description, in the low-speed brake apparatus according to the present invention, two step sprockets 100 and a driving sprocket 102 engaged with step chains installed under a step (not shown) onto which a passenger steps are fixed on both sides of a driving shaft 101, respectively.

Furthermore, a driving chain 103 inserted into the rotation shaft of a driving motor 104 rotates the driving sprocket 102 so that the step sprockets 100 fixed on the same axis are rotated, thereby driving the step. Accordingly, a brake sprocket 105 additionally installed on the driving shaft 101 is also rotated. The low-speed brake apparatus further includes a follower sprocket 201 connected to a brake chain 106 so that it operates in conjunction with the brake sprocket 105, an electronic clutch 300 regulating connection between the follower sprocket 201 and a transmission gear 200, a brake motor 400 rotated by the transmission gear 200, a plurality of switching means connected to a plurality of windings, that is, the stator of the brake motor 400, and a controller 500 for supplying an operation pulse to selected switching means so that a rotation load applied to the rotor 402 of the brake motor 400 is increased at a smooth speed.

Figure 5:
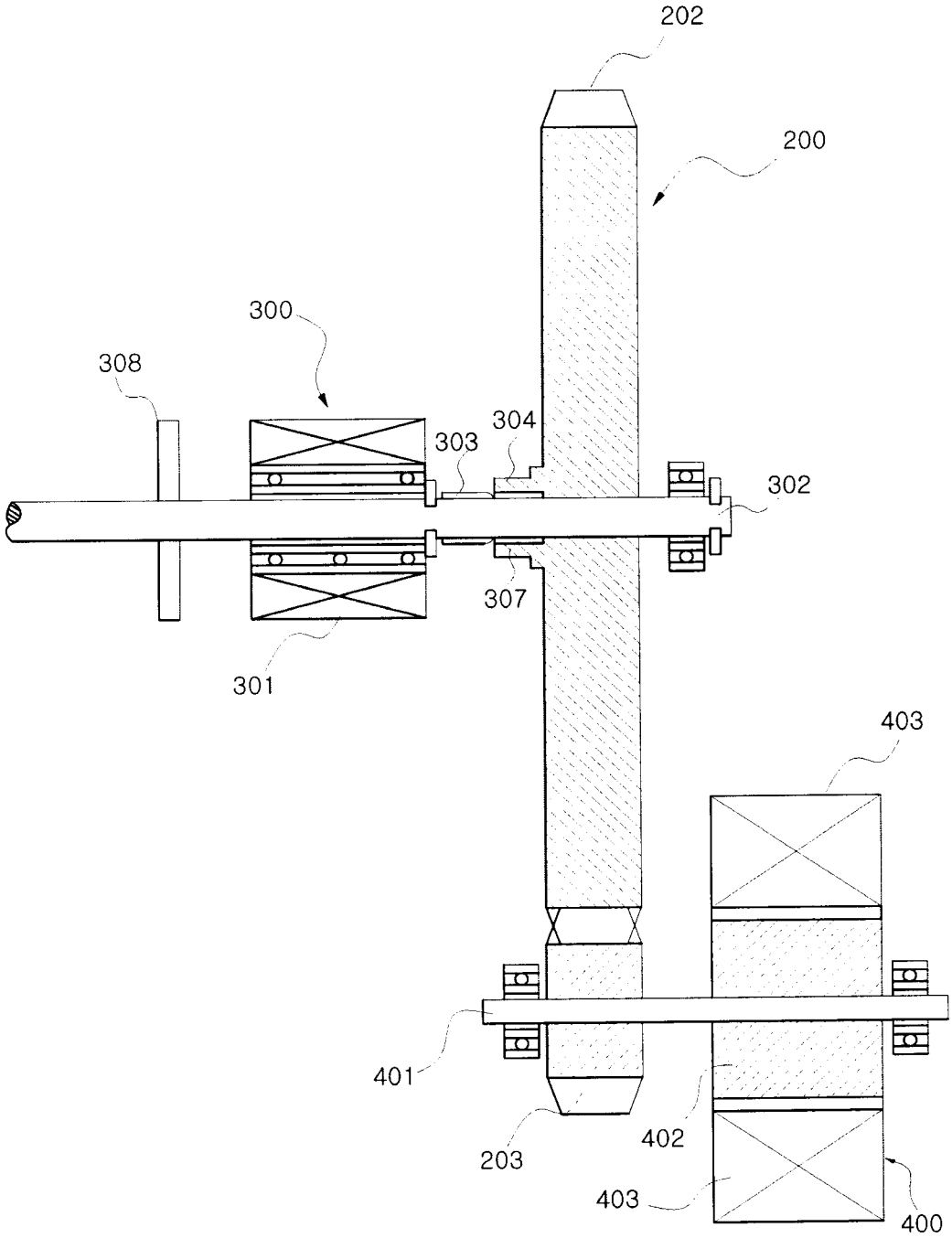
FIG. 5 is an explanatory diagram showing an electronic clutch and a transmission gear which may be applied to the present invention.

As described above, in an escalator according to the present invention, in a normal operating state, the electronic clutch 300 does not operate under the control of the controller 500. Accordingly, the brake sprocket 105 fixed to the driving shaft 101 and a rotation shaft 302 rotated by the brake chain 106 move to the left of FIG. 2 by the elastic force of a return spring 305, such as that shown in an enlarged portion "A" of FIG. 2. As shown in FIG. 5, a spline 303 stands by outside the boss 304 of a large gear 202, and thus the rotating force of the rotation shaft 302 is not transferred to the large gear 202. Accordingly, since the electronic clutch 300 does not yet operate, the rotation shaft 302 is separated from the transmission gear 200 and the center shaft 401 of the brake motor 400, and thus the driving shaft 101 rotates in the state in which any braking has not applied to the driving shaft 101. In this state, when the driving chain 103 is rotated by the motive power of the driving motor 104 and the driving chain 103 rotates the driving sprocket 102, the driving shaft 101 rotates, the step sprockets 100 fixed to the driving shaft 101 rotate, and step chains (not shown) rotate. Accordingly, the step and a hand rail move at a stable speed in the direction in which the driving motor 104 rotates. As a result, a passenger who steps onto the step can move to an upper floor or a lower floor safely and conveniently.

Figure 6:
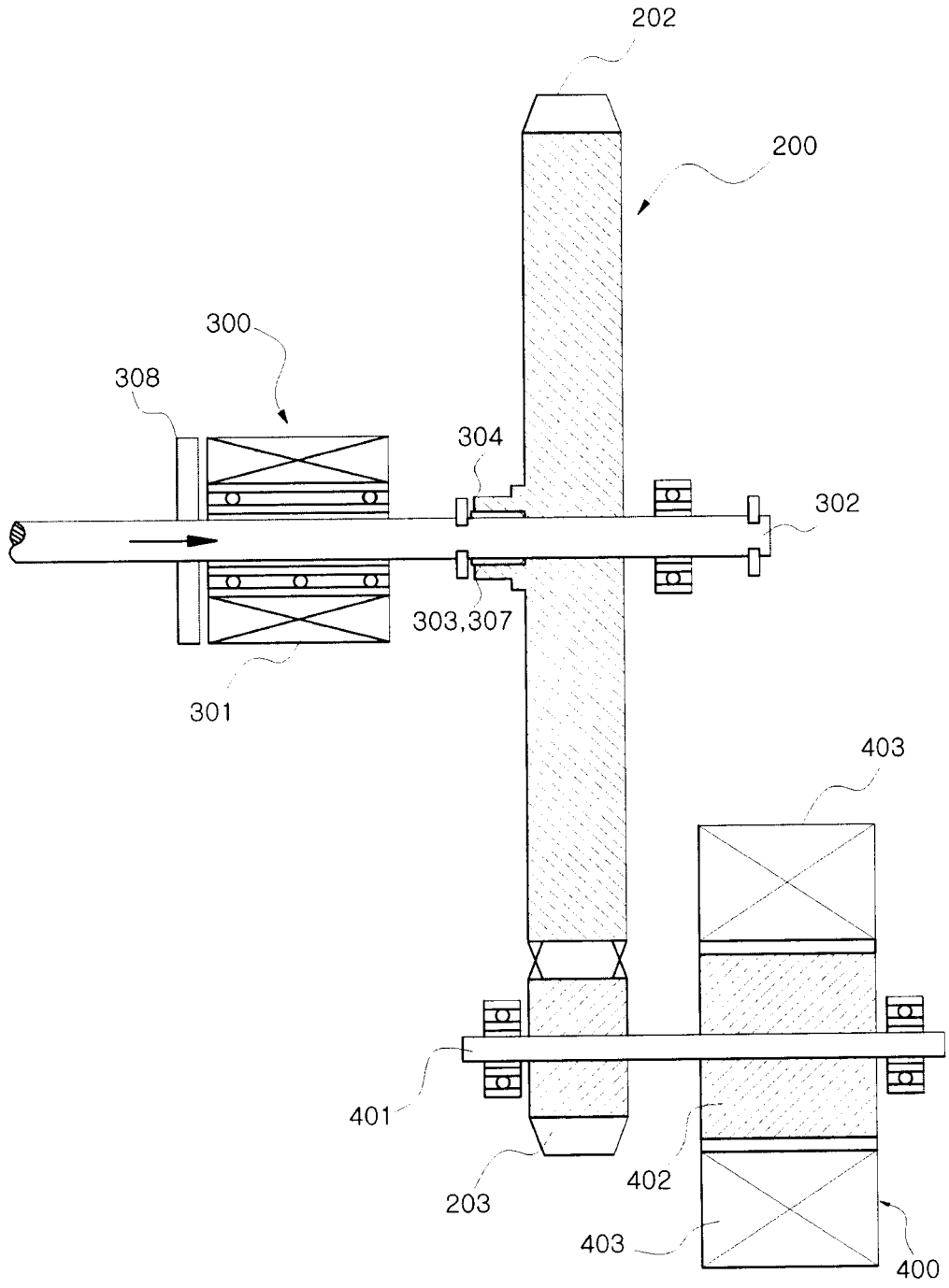
FIG. 6 is an explanatory diagram showing the operating state of FIG. 5.

In such a normal operation state, when an unexpected accident, such as the breakage or get-between detection of the driving chain 103, is generated, the controller 500 drives the electronic clutch 300 to move the rotation shaft 302 to the right of FIG. 6, as shown in FIG. 6. Accordingly, the spline 303 of the rotation shaft 302 is coupled to a slit 307 formed in the boss 304 of the large gear 202. As a result, a rotatory power transferred through the brake sprocket 105 fixed to the driving shaft 101 and the brake chain 106 changes the state so that the transmission gear 200 operates in conjunction with the center shaft 401 of the brake motor 400 through the electronic clutch 300.

Figure 4:
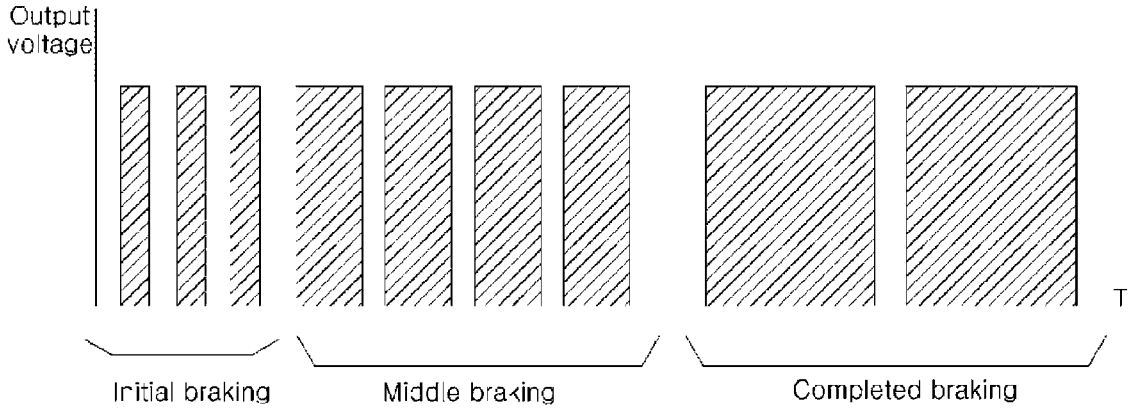
FIG. 4 is a waveform showing output pulses output by a controller according to the present invention.

At this time, the controller 500 generates an output pulse for braking in order to stop the operation of the motor. As shown in FIG. 4, the output pulse is generated so that a duty rate $t_{on}/(t_{on}+t_{off})$, that is, a rate of an ON time $t_{on}$ and OFF time $t_{off}$, is gradually increased.

Such a duty ratio is output of the controller 500 implemented using a microprocessor, and may be set by a program.

As described above, as shown in FIG. 4, the duty ratio is small at the initial stage of braking and then gradually increased. Accordingly, if the output pulse maintains a high level when braking is completed, the switching means maintains a turn-on state and thus a maximum current flows into each of the windings of the brake motor 400, thereby forming the strongest magnetic force. Accordingly, a permanent magnet, that is, the rotor 402, becomes a state in which it is difficult to rotate.

Figure 7:
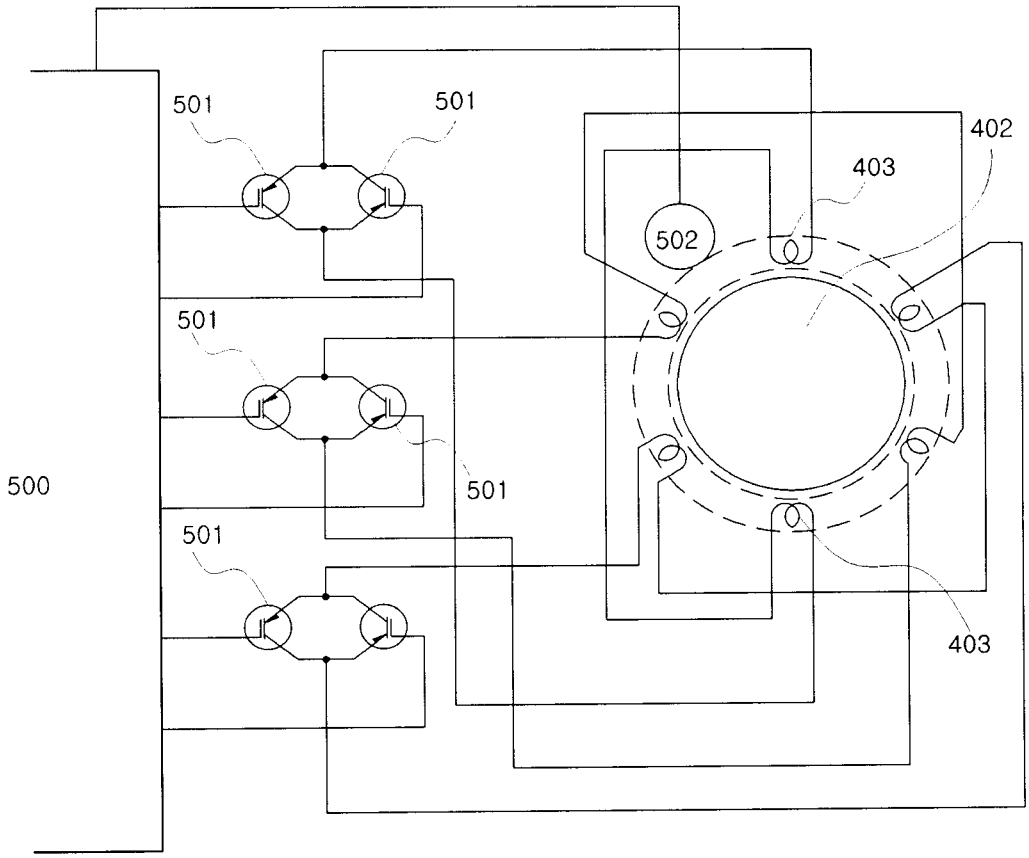
FIGS. 7 and 8 are circuit diagrams showing the configuration of switching means which may be applied to the present invention.
Figure 8:
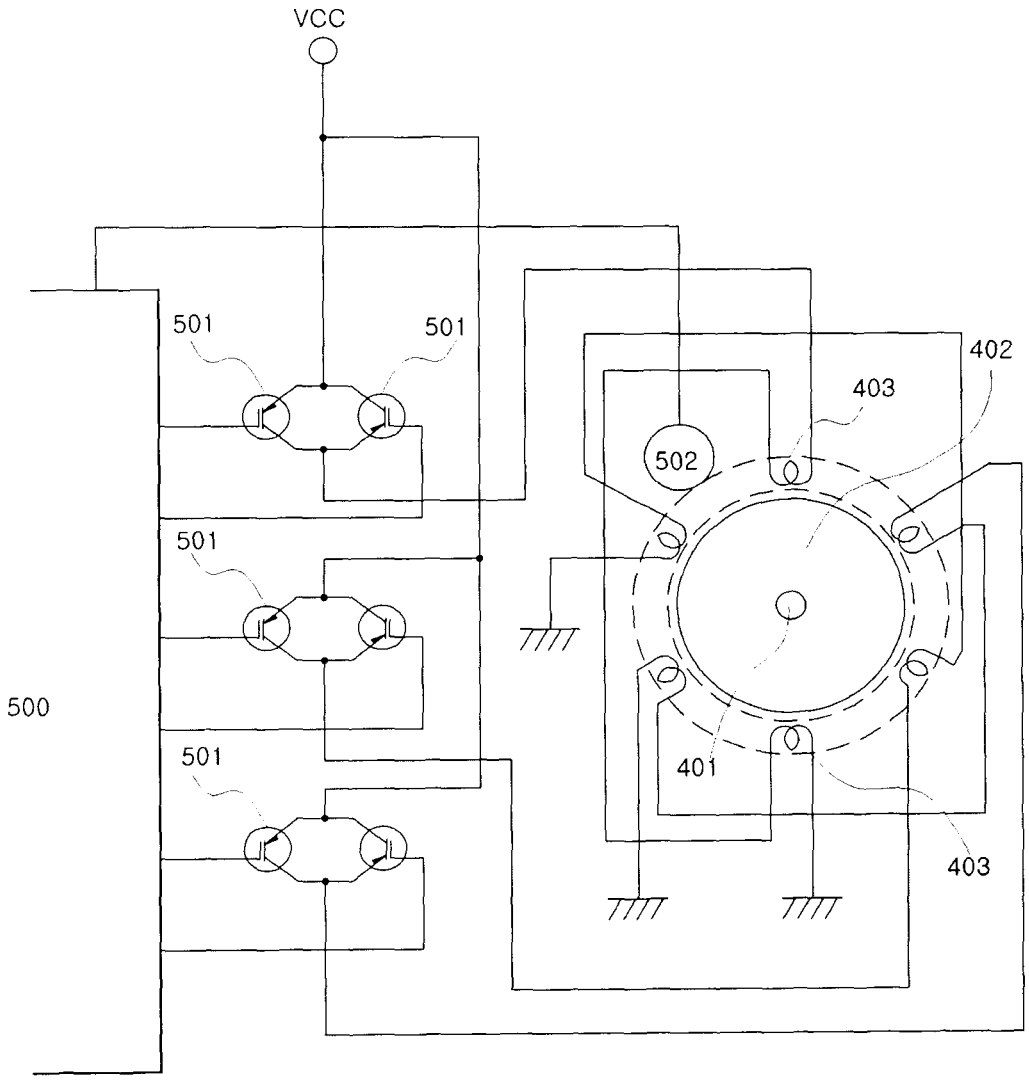

In the present invention, for a switching implementation, an example in which Insulated Gate Bipolar Transistors (IGBT) 501 suitable for high power control have been used is illustrated in FIGS. 7 and 8. An example in which the IGBTs 501 have been used is described below, for convenience sake.

Accordingly, at the initial stage of braking having a small duty ratio, the amount of current that flows into surrounding windings due to the rotation of the rotor 402 of the brake motor 400 is small because the time when an electric current flows by the IGBTs 501 are short. Accordingly, a magnetic force generated from the fixed winding 403, that is, a stator, is weak, and thus a braking power applied to the rotor 402 of the brake motor 400 is not great. In such an initial state, when braking is increased to a middle level, the duty ratio gradually increases, and thus the time when an electric current flows due to the IGBTs 501 is increased. Accordingly, the amount of current flowing into the surrounding fixed winding 403 is increased due to the rotation of the rotor 402 of the brake motor 400, and thus a magnetic force generated from the fixed winding 403, that is, the stator, becomes strong. As a result, a braking power is increased because it becomes difficult for the rotor 402 of the brake motor 400 to easily rotate.

When a set braking completion time is reached over time as described above, the electric current continues to flow by the IGBT 501. Accordingly, the amount of current flowing into the surrounding winding becomes a maximum by the rotation of the rotor 402 of the brake motor 400, and thus a magnetic force generated from the fixed winding 403, that is, the stator, becomes the strongest. As a result, the braking power becomes a maximum because the rotation of the rotor 402 of the brake motor 400 is stopped. Accordingly, the transmission gear 200 connected to the rotor 402 of the brake motor 400, the electronic clutch 300, the brake chain 106, the brake sprocket 105, and the driving shaft 101 cannot be rotated. As a result, the step chains and the step rotated by the step sprockets 100 are stopped because the step sprockets 100 are not rotated.

Furthermore, in the present invention, the IGBT 501 has been illustrated as an example of high-power switching means, for convenience sake. However, a high-power transistor may be used as an example of the high-power switching means, and various other switching elements, such as a triac, may be used.

Furthermore, in the present invention, in order to smoothly control a flow of an electric current although the direction of an induced electromotive force induced by the fixed winding 403 is reversed depending on the rotation direction of the rotor 402, PNP and NPN IGBTs 501 are connected in parallel. The controller 500 selectively applies output of a high level or low level to the gates of the IGBTs 501.

As described above, in the present invention, the output pulse for braking is applied to the brake motor 400, and a full braking state is reached after a set time elapses. Accordingly, the step is stopped at a smooth speed that has been safely optimized without the falling down of a passenger.

Furthermore, in the present invention, the electronic clutch 300 operates by output supplied by the controller 500 and transfers a braking power. If output is not supplied by the controller 500, the electronic clutch 300 is separated from the transmission gear 200 and a braking power is never transferred. Accordingly, the driving shaft 101 normally operates and moves the step up or down. The structure of a representative electronic clutch 300 and transmission gear 200 which may be applied to the present invention is shown in FIG. 5.

As may be seen from FIG. 5, in the low-speed brake apparatus according to the present invention, the brake chain 106 connected and rotated by the brake sprocket 105 rotates the follower sprocket 201. The follower sprocket 201 includes the electronic clutch 300 including the rotation shaft 302 equipped with the spline 303, a clutch coil 301, and the slit 307 formed in the boss 304 of the large gear 202 forming the transmission gear 200, the transmission gear 200 including the large gear 202 and a pinion 203, and the center shaft 401 of the brake motor 400 coupled to the pinion 203.

In accordance with such an embodiment, the spline 303 has been illustrated as being formed in the rotation shaft 302 fixed to the center of the follower sprocket 201 rotated by the brake chain 106. Such a spline 303 is connected to the follower sprocket 201 by the slit 307 formed in the boss 304 of the large gear 202 of the transmission gear 200.

Accordingly, in the present invention, when an electric current supplied by the controller 500 flows into the clutch coil 301 of the electronic clutch 300, the clutch coil 301 sucks the rotation shaft 302, and thus the rotation shaft 302 of the follower sprocket 201 moves to the left of FIG. 6, as shown by an arrow of FIG. 6.

As a result, the rotatory power of the follower sprocket 201 rotated by the brake chain 106 is coupled to the slit 307 formed in the boss 304 of the large gear 202 to which the spline 303 is coupled, thereby rotating the pinion 203. Accordingly, the center shaft 401 of the brake motor 400 is rotated and thus the rotor 402 starts to rotate thereby generating an induced electromotive force in the fixed winding 403 of the brake motor 400. The induced electromotive force flows into the fixed winding 403 and is magnetized so that it has polarity opposite that of the rotor 402, that is, a permanent magnet. As a result, the rotor 402 is sucked by the fixed winding 403, thereby making the rotor 402 difficult to rotate.

Accordingly, the rotatory power supplied by the brake chain 106 reaches the brake motor 400 through the follower sprocket 201, the large gear 202 of the transmission gear 200, and the pinion 203. However, the rotor 402 fixed on the same axis as the center shaft 401 of the pinion 203 becomes difficult to rotate by the fixed winding 403, thereby making the brake chain 106 difficult to rotate. Accordingly, braking is applied to even the brake sprocket 105 and the driving shaft 101. As a result, the rotation of the step sprockets 100 fixed on the same axis as the driving shaft 101 is braked to limit a movement of the step.

Accordingly, the braking power by the brake motor 400 is applied to the step onto which a passenger steps through such a process. More specifically, in the present invention, a braking power is smoothly increased during period from the time when an operation is started to the time when the operation is terminated by controlling a flow of the electric current of an induced electromotive force flowing into the fixed winding 403 of the brake motor 400. Accordingly, a corresponding escalator is stopped at an optimum speed so that a passenger who has stepped on a step does not fall down. In the present invention, the electronic clutch 300 and the transmission gear 200 have been illustrated as examples in FIGS. 5 and 6, but various types of electronic clutches 300 and transmission gears 200 may be used in addition to the aforementioned structures.

Furthermore, in the present invention, an example in which three pairs of the windings of the brake motor 400 have been installed is illustrated. For example, a single IGBT 501 may be connected to three pairs of the windings in each of which two controllers 500 forms a pair. A phase angle detection sensor 502 for detecting an angle of the rotor 402 and selecting and controlling the IGBTs 501 connected to both ends of the fixed winding 403 in accordance with the detected angle of the rotor 402 has been installed.

Furthermore, in the present invention, the brake motor 400 may have a low-power generation capability in accordance with deceleration because it adopts an electrical braking method, and thus may have the possibility that a braking power is also reduced. In order to overcome such a problem, a brake caliper, such as that of cited invention, and known mechanical braking means using a disk brake may be used in combination with the brake motor 400 in order to further enhance safety.

Furthermore, in the present invention, an external power source VCC is applied to the fixed winding 403 of the brake motor 400 via a switching element as operation power. Accordingly, a strong braking power can be exerted from the initial braking stage to the braking completion stage by controlling the controller 500 so that torque is generated in an inverse direction to the rotation direction. In such a case, the mechanical braking means does not need to be accessorily used. Such an embodiment is shown in FIG. 8.

Furthermore, in the present invention, the rotatory power of the brake sprocket 105 has been illustrated as being transferred to the follower sprocket 201 using the brake chain 106. For example, various motive power transfer means, such as a time belt, may be used instead of the brake chain 106.

Furthermore, in the present invention, in order for the electronic clutch 300 to smoothly operate, a magnetism plate 308 may be installed on one side of the rotation shaft 302. When the clutch coil 301 is magnetized by the magnetism plate 308, the rotation shaft 302 immediately moves to the right of FIG. 5, thereby being capable of generating a rapid braking power.

Furthermore, in the present invention, since the follower sprocket 201 is rotated by the brake chain 106 and the large gear 202 is rotated by the follower sprocket 201, the center shaft of the brake motor 400 engaged with the pinion 203 is rotated at a high speed, but torque is reduced in accordance with the increase of the rotation speed. Accordingly, the driving shaft 101 in addition to the follower sprocket 201 can be strongly braked by a small braking power.

As described above, in the present invention, the amount of current that flows per hour in the switching element can be controlled by an operation pulse supplied by the controller. A magnetic pole formed in the fixed winding controls a time width in which the rotation of the permanent magnet, that is, a rotor, is suppressed by adjusting the amount of current that flows into the fixed winding, that is, the stator of the brake motor. Accordingly, the rotation of the brake sprocket and the driving shaft fixed to the center of the brake sprocket can be suppressed and stopped at a smooth speed in response to an operation pulse supplied by the controller. Accordingly, there is an advantage in that human life can be protected because a passenger who steps onto a step can be safely stopped.

Furthermore, in the present invention, an optimum stop consumption time can be set in accordance with volumes, such as the number of passengers who boards an escalator and weight of steps, through control of the duty cycle of an operation pulse by only modifying a program installed on the controller. Accordingly, there are advantages in that an escalator can operate silently because it can be stopped safely and rapidly and there is no noise generated in a braking operation process.

As described above, the present invention is not limited to the aforementioned embodiments, but may be changed and implemented in various ways without departing from a gist and concept intended by the present invention.

What is claimed is:

1. A low-speed brake apparatus for an escalator, comprising:

a brake sprocket installed on a driving shaft, wherein step sprockets engaged with step chains and a driving sprocket are installed on the driving shaft and a driving chain inserted into a rotation shaft of a driving motor rotates the driving sprocket so that a step is driven;

a follower sprocket connected to the brake sprocket by a brake chain in such a way as to operate in conjunction with the brake sprocket;

an electronic clutch regulating connection between the follower sprocket and a transmission gear;

a brake motor having a center shaft rotated by the transmission gear;

a plurality of switching means connected to a plurality of windings which is a stator of the brake motor; and a controller for supplying an operation pulse to selected switching means.

2. The low-speed brake apparatus of claim 1, wherein the electronic clutch is connected to the controller for outputting a stop signal when abnormality occurs.

3. The low-speed brake apparatus of claim 1, wherein:

the brake chain connected to the brake sprocket and rotated in conjunction with the brake sprocket rotates the follower sprocket, and the follower sprocket comprises a slit formed in a boss of a large gear comprising a rotation shaft equipped with a spline, a clutch coil, and the transmission gear.

4. A low-speed brake apparatus for an escalator, comprising:

a brake sprocket installed on a driving shaft, wherein step sprockets engaged with step chains and a driving sprocket are installed on the driving shaft and a driving chain inserted into a rotation shaft of a driving motor rotates the driving sprocket so that a step is driven;

a follower sprocket connected to the brake sprocket by a brake chain in such a way as to operate in conjunction with the brake sprocket;

an electronic clutch regulating connection between the follower sprocket and a transmission gear; and a brake motor having a center shaft rotated by the transmission gear, wherein an operation pulse is supplied to a plurality of windings which is a stator of the brake motor by a plurality of switching means, and torque is generated in a reverse direction to a rotation direction of the brake motor by power from an external power source.

* * * * *